United States Patent [19]

Bonanno

[11] Patent Number: 4,815,578

[45] Date of Patent: Mar. 28, 1989

[54] COIN-CONTROLLED MECHANISM FOR A PRODUCT DISPENSER

[76] Inventor: Joseph Bonanno, 1 McKinley St., Linden, N.J. 07036

[21] Appl. No.: 78,979

[22] Filed: Jul. 29, 1987

[51] Int. Cl.[4] ..... G07F 5/04

[52] U.S. Cl. ..... 194/237; 194/291

[58] Field of Search ..... 194/237, 238, 290, 291, 194/292, 344, 342, 343

[56] References Cited

U.S. PATENT DOCUMENTS

| | | | |
|---|---|---|---|
| 2,804,959 | 9/1957 | Cerecke | 194/292 |
| 3,270,848 | 9/1966 | Hall | 194/237 |
| 3,970,181 | 7/1976 | Rubio | 194/291 X |
| 4,363,393 | 12/1982 | McDonald | 194/237 |
| 4,436,194 | 3/1984 | Hanley | 194/292 |

*Primary Examiner*—Kevin P. Shaver

*Assistant Examiner*—Edward S. Ammeen

[57] ABSTRACT

The Mechanism has a platform which has a coin chute formed thereon, and which rotatably journals a slotted plate. In opposite 180° positions a plate slot aligns with the coin chute, there being two of such slots. Each slot has an abutment which, when the slot is aligned with the coin chute, is engageable by a spring-biased pawl to prevent rotation of the plate if no coinage, or inadequate coinage has been passed through the chute to occupy the chute-aligned slot. A second pawl engages reliefs formed in the plate to hold the plate in a position in which a slot is aligned with the chute, and a spring-loaded arm, pivotably coupled to the platform, also positions the plate for coinage reception. An arcuate wall fixed to the platform, and circumjacent the plate, guides coinage to a bottom portion of the Mechanism.

14 Claims, 2 Drawing Sheets

COIN-CONTROLLED MECHANISM FOR A PRODUCT DISPENSER

This invention pertains to coin-controlled product-dispensing devices, and in particular to an improved coin-operated mechanism for a controlled dispenser.

Such mechanisms are known in the prior art, of course, but commonly they are rather complicated assemblies, having a considerable number of parts. Consequently, the known mechanisms are expensive to manufacture, pose parts stocking problems, and are costly to repair and rebuild.

It is an object of this invention to set forth a coin-controlled mechanism for a product dispenser which is remarkably simple, has a minimal number of discrete parts, and is inexpensive to manufacture and maintain.

It is particularly an object of this invention to disclose a coin-controlled mechanism for a product dispenser, comprising a platform; a slotted plate; and means rotatably journalling said plate on said platform; said platform having a coin chute; said plate having a slot formed therein for slidably receiving coinage therein; said slot having an open end; wherein said open end of said slot aligns with said chute when said plate is in a given disposition; and means coupled to said plate for holding coinage in said slot; wherein said slot comprises means defining an abutment; and blocking means coupled to said platform displaceably engageable with said abutment for prohibiting rotation of said plate; and limit stop means in said slot for determining how far into said slot coinage shall travel.

It is a further object of this invention to set forth a coin-controlled mechanism for a product dispenser, comprising a platform; a slotted plate; and means rotatably journalling said plate on said platform; wherein said platform has a coin chute; said plate has a pair of slots formed therein for slidably receiving coinage therein; each said slot has an open end; said open ends are on opposite sides of said plate; said open end of one of said slots aligns with said coin chute when said plate is in one of two given positions, and said open end of the other of said slots aligns with said coin chute when said plate is in the other of said two given posiitons; and means coupled to said plate for holding coinage in said slots; each said slot comprises means defining an abutment; and blocking means coupled to said platform displaceably engageable with said abutment of said one slot when said plate is in said one position, and engageable with said abutment of said other slot when said plate is in said other position, said blocking means comprising means for prohibiting rotation of said plate.

Figure 1:
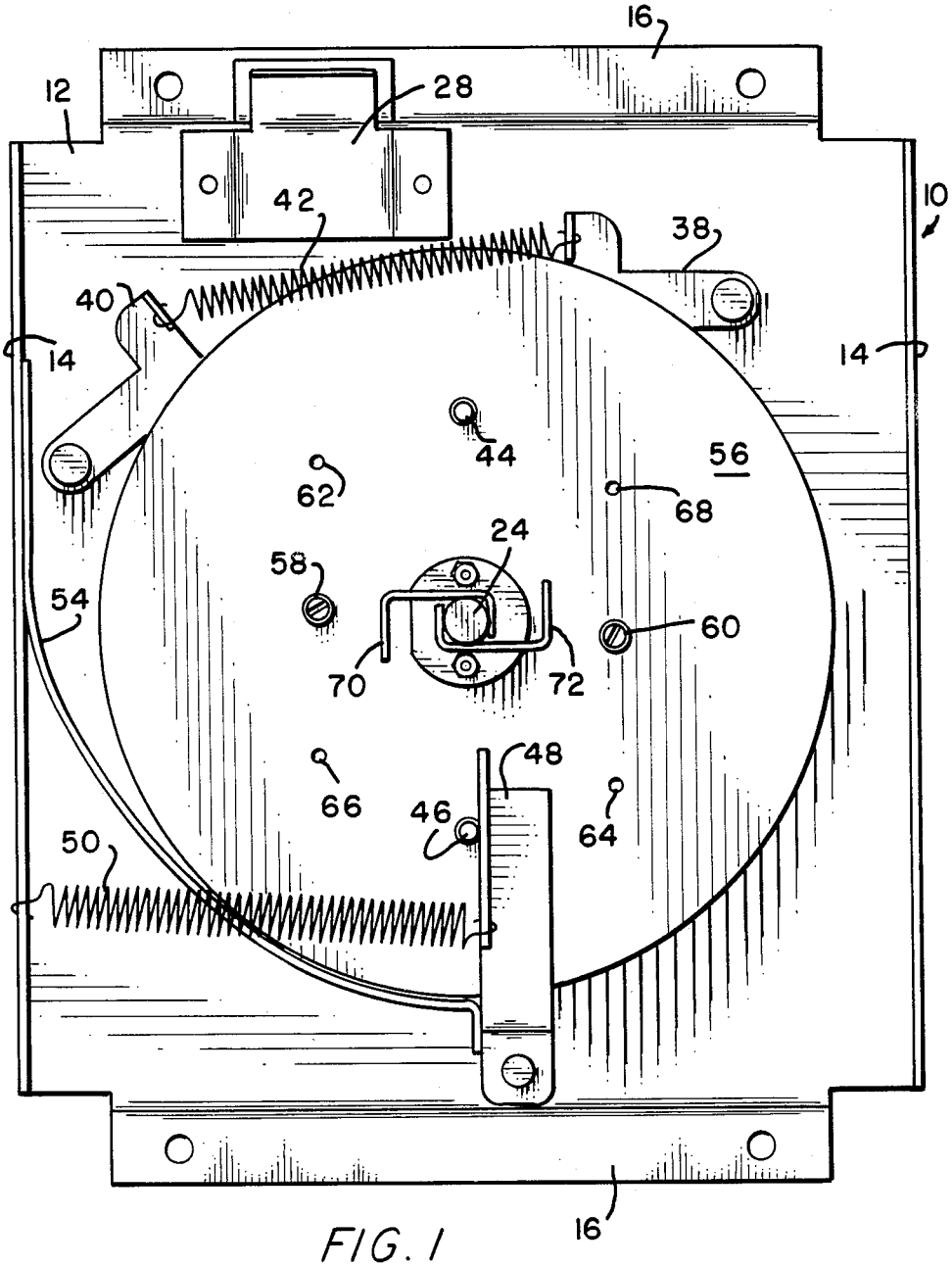
Figure 2:
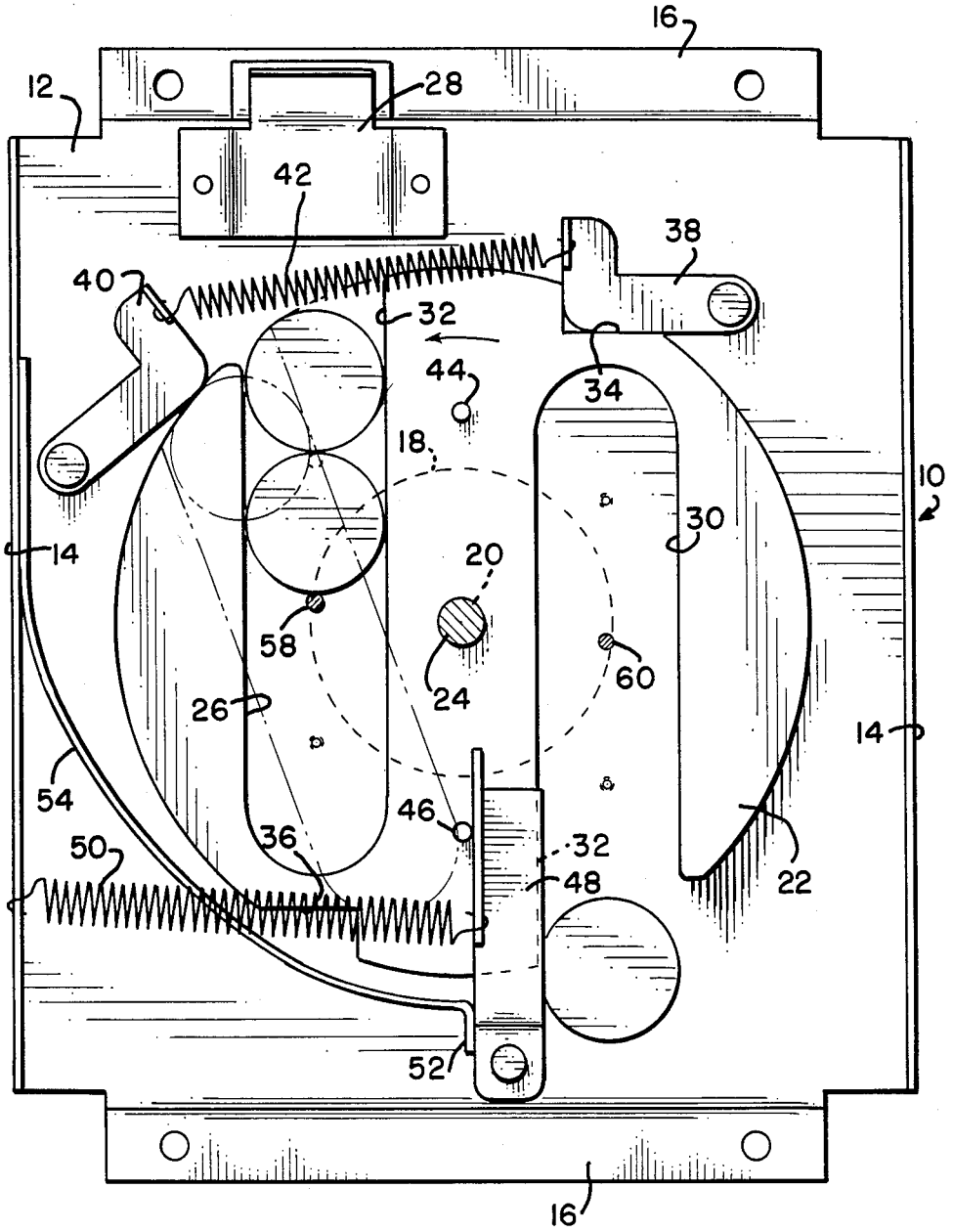

Further objects of this invention, and the features thereof, will become more apparent by reference to the following description taken in conjunction with the accompanying figures, in which:

FIG. 1 is an elevational view of the mechanism, according to an embodiment thereof; and FIG. 2 is a view like that of FIG. 1 in which, however, the cover plate is removed from the slotted plate.

As shown in the figures, the novel coin-controlled mechanism 10 comprises a platform 12 having parallel walls 14 and parallel mounting flanges 16 thereabout. The platform 12 has on the hidden, reverse side an operating knob 18 which is mounted on a shaft 20 which is journalled in the platform. Too, a slotted plate 22 is rotatably journalled in the platform 12 by means of a shaft 24 which (by means not shown) is coupled to shaft 20 to effect rotation of said plate 22 coincident with rotation of the knob 18. Plate 22 has a pair or parallel slots formed therein in which, alternately, to receive coinage. In FIG. 2, slot 26 is shown aligned with a coin chute 28 formed in the platform 12; slot 30 is shown rotated one hundred and eighty degrees of arc away from the coin chute 28. Each slot has a surface portion which defines an abutment 32. The plate 22 further has two right-angular reliefs 34 and 36 formed in the periphery thereof on opposite sides thereof. A pawl 38, pivoted on the platform 12, is engaged with the relief 34. A second pawl 40 is pivoted to the platform 12 and, as shown in FIG. 2, has a surface which rides upon the periphery of the plate 22. An extension spring 42 is coupled to both pawls to urge both toward the plate 22.

A pair of pins 44 and 46 are fixed in the plate 22 and project outwardly therefrom. Pin 46 is positioned against an arm 48 which is pivotably mounted on the platform 12 and lies over the plate 22. An extension spring 50 is fixed to the platform 12 and the arm 48 to hold the arm against an abutment 52. Abutment 52 is at the end of an arcuate coin guide 54 which is fixed to the platform 12 and projects therefrom A cover plate 56 is fastened to the slotted plate 22; the pins 44 and 46 penetrate holes provided therefor, in plate 56, and are spot-welded to plate 56 thereat to secure plates 22 and 56 together. Bolts 58 and 60 are removably fastened in tapped holes in plate 56 and project therefrom to determine how many coins shall be needed to operate the mechanism 10. The bolts intrude into the slots 26 and 30 and, consequently provide limit stops for coinage. They fix the limit for coins entering the slots. As shown in FIG. 2, bolt 58 is so positioned that only two coins (quarters) will fit in the slot 26. Upon the plates 56 and 22 being rotated one hundred and eighty degrees, slot 30 will come into alignment with the coin chute 28, and it too will accommodate only two coins due to the positioning of bolt 60. To operate the mechanism one must put two coins in the coin chute to fill the available space in the chute-aligned slot (26 or 30). If only one coin is in the aligned slot, pawl 40 will slue into blocking engagement with the abutment 32, when the knob 18 is tuned. Hence, the plates 22 and 56 will only turn approximately twenty degrees of arc. Then, spring-biased arm 48 will return the plates to the chute-slot aligned positioning again, and pawl 38 will drop into the relief 34. If the slot 26 is filled with two coins, the outermost coin will prevent the pawl 40 from engaging and blocking the abutment 32. This is simulated by the dashed line illustration in FIG. 2. In this circumstance, the plates 22 and 56 can turn a full one hundred and eighty degrees, plus another appoximately twenty degrees until pawl 40 blockingly engages the abutment 32 of slot 30. Again, arm 48 will force the plates 22 and 56 to retract the aforesaid approximately twenty degrees, and pawl 38 will drop into the relief 36. This sets the mechanism up for a successive coin-operative functioning, now with slot 30 in alignment with the coin chute 28. Coins which enable operation of the mechanism 10, roll out of the receiving slot after the latter has turned beyond ninety degrees of arc, and such coins run along the wall 54 to exit the mechanism at the bottom (to be received in a strong receptacle which is not shown). If it is desired to have the mechanism operate with single coins, one has only to reposition the bolts 58 and 60 in holes 62 and 64, respectively, which are provided therefor in plate 56. Or, to require that three coins be used for mechanism operation, the bolts can be set in the further holes 66 and 68.

Clearly, plates like that of plate 56 can be fabricated with carefully positioned holes to accommodate all manner of coinage, domestic and foreign. Similarly, plates like plate 22 can be fabricated with complementary-sized slots for the differing coinage. Extending from the plate 56 on the shaft are operating limbs 70 and 72. Limbs 70 and 72, of right-angular configuration, are the means by which product is dispensed from a container (not shown). One of the limbs is adjacent to the end of the shaft, and the other is fixed intermediate the length of the shaft, in order that they may release product from separate tracks or guideways in the container. However, this pertains to a dispenser, per se, which is not part of this disclosure.

While I have described my invention in connection with a specific embodiment thereof it is to be clearly understood that this is done only by way of example and not as a limitation to the scope of my invention, as set forth in the objects thereof and in the appended claims.

I claim:

1. A coin-controlled mechanism for a product dispenser, comprising:

a platform;

a slotted plate; and means rotatably journalling said plate on said platform;

said platform having a coin chute;

said plate having a slot formed therein for slidably receiving coinage therein;

said slot having parallel edges which define a void therebetween, and an open end; wherein said open end of said slot aligns with said chute when said plate is in a given disposition; and means coupled to said plate for holding coinage in said slot; wherein said slot comprises means defining an abutment; and blocking means coupled to said platform displaceably engageable with said abutment for prohibiting rotation of said plate; and limit stop means protruding into said void in said slot for determining how far into said slot coinage shall travel.

2. A coin-controlled mechanism for a product dispenser, according to claim 1, wherein:

said coinage holding means comprises a cover plate fastened to said slotted plate;

3. A coin-controlled mechanism for a product dispenser, according to claim 1; wherein:

said plate has a relief formed therein; and further including latching means releaseably engageable with said relief for holding said plate in said given disposition.

4. A coin-controlled mechanism for a product dispenser, according to claim 3, further including:

means coupling said blocking means and said latching means together.

5. A coin-controlled mechanism for a product dispenser, according to claim 4, wherein:

said coupling means comprises an extension spring.

6. A coin-controlled mechanism for a product dispenser, according to claim 3, wherein:

said blocking means and said latching means comprise pawls pivotably mounted to said platform.

7. A coin-controlled mechanism for a product dispenser, according to claim 1, further including:

an arcuate wall, coupled to said platform, for guiding coinage therealong,

8. A coin-controlled mechanism for a product dispenser, according to claim 1, further including:

an arm pivotably coupled to said platform, and movable across said plate;

means on said plate for impingingly engaging said arm for holding said plate in said given disposition.

9. A coin-controlled mechanism for a product dispenser, according to claim 8, wherein:

said arm engaging means comprises a pin fixed in said plate and extending therefrom.

10. A coin-controlled mechanism for a product dispenser, according to claim 9, further including:

an arcuate wall, coupled to said platform, for guiding coinage therealong; wherein said wall has means for limiting pivotable movement of said arm in a given direction.

11. A coin-controlled mechanism for a product dispenser, according to claim 10, further including:

means intercoupling said arm and said platform for biasingly holding said arm in engagement with said movement limiting means.

12. A coin-controlled mechanism for a product dispenser, comprising:

a platform;

a slotted plate; and means rotatably journalling said plate on said platform; wherein said platform has a coin chute;

said plate has a pair of elongated slots each having a longitudinal axis, formed therein for slidably receiving coinage therein wherein the longitudinal axes of said slots are parallel;

each said slot has an open end;

said open ends are on opposite sides of said plate;

said open end of one of said slots aligns with said coin chute when said plate is in one of two given dispositions, and said open end of the other of said slots aligns with said coin chute when said plate is in the other of said two given dispositions; a means coupled to said plate for holding coinage in said slots; wherein each said slot comprises means defining an abutment; and blocking means coupled to said platform displaceably engageable with said abutment of said one slot when said plate is in said one disposition, and engageable with said abutment of said other slot when said plate is in said other disposition, said blocking means comprising means for prohibiting rotation of said plate.

13. A coin-controlled mechanism for a product dispenser, according to claim 12, wherein:

said coinage holding means comprises a cover plate fastened to said slotted plate.

14. A coin-controlled mechanism for a product dispenser, according to claim 12, wherein:

said plate has a pair of reliefs formed therein on opposite sides of said plate; and further including latching means releasably engageable with one of said reliefs when said plate is in one of said two dispositions, to hold said plate in said one disposition, and releasably engageable with the other of said reliefs when said plate is in said other disposition, to hold said plate in said other disposition.

* * * * *